US008376351B2

(12) United States Patent
Ishikura

(10) Patent No.: US 8,376,351 B2
(45) Date of Patent: Feb. 19, 2013

(54) RECORDING MEDIUM TRANSPORTING DEVICE AND IMAGE FORMING APPARATUS

(75) Inventor: Kenichi Ishikura, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 13/040,892

(22) Filed: Mar. 4, 2011

(65) Prior Publication Data

US 2012/0070213 A1 Mar. 22, 2012

(30) Foreign Application Priority Data

Sep. 22, 2010 (JP) ..... 2010-212178

(51) Int. Cl.
*B65H 3/06* (2006.01)

(52) U.S. Cl. ..... 271/119

(58) Field of Classification Search ..... 271/119, 271/109

See application file for complete search history.

(56) References Cited

U.S. PATENT DOCUMENTS

2006/0017213 A1 1/2006 Maeda et al.

FOREIGN PATENT DOCUMENTS

JP 04075934 A * 3/1992
JP 10236673 A * 9/1998
JP 2003-128275 A 5/2003

* cited by examiner

*Primary Examiner* — Luis A Gonzalez
(74) *Attorney, Agent, or Firm* — Sughrue Mion, PLLC

(57) ABSTRACT

A recording medium transporting device includes a shaft member that rotates when driving force is transmitted thereto, and that includes a pair of first flat plate portions, a second flat plate portion, and a through hole or a cutaway portion; a sending-out member having a recessed open portion, the shaft member being fitted to the open portion from a direction that crosses an axial direction of the shaft member; and a sandwiching portion capable of being inserted into and removed from the through hole or the cutaway portion from the direction that crosses the axial direction of the shaft member, and sandwiching the flat plate portion of the shaft member between the bottom wall and the sandwiching portion when the sending-out member is moved in the axial direction while the sandwiching portion is inserted in the through hole or the cutaway portion.

5 Claims, 12 Drawing Sheets

RECORDING MEDIUM TRANSPORTING DEVICE AND IMAGE FORMING APPARATUS

CROSS-REFERENCE TO RELATED APPLICATIONS

This application is based on and claims priority under 35 USC 119 from Japanese Patent Application No. 2010-212178 filed Sep. 22, 2010.

BACKGROUND

(i) Technical Field

The present invention relates to a recording medium transporting device and an image forming apparatus.

SUMMARY

According to an aspect of the invention, there is provided a recording medium transporting device including a long shaft member that rotates when driving force is transmitted thereto, the shaft member including a pair of first flat plate portions, a second flat plate portion, and a through hole or a cutaway portion, the pair of first flat plate portions opposing each other in cross section that crosses a longitudinal direction, the second flat plate portion connecting a widthwise-direction end of each first flat plate portion to each other, the pair of first flat plate portions and the second flat plate portion forming a rectangular shape, the through hole or the cutaway portion being formed in one of the flat plate portions; a sending-out member whose outer peripheral surface contacts a topmost recording medium that is loaded, the sending-out member having a recessed open portion provided in a portion of the outer peripheral surface, the shaft member being fitted to the open portion from a direction that crosses an axial direction of the shaft member, the sending-out member sending out the topmost recording medium that is loaded while the sending-out member rotates as a result of the rotation of the shaft member fitted to the open portion; and a sandwiching portion provided at a bottom wall of the open portion of the sending-out member, the sandwiching portion capable of being inserted into and removed from the through hole or the cutaway portion from the direction that crosses the axial direction of the shaft member, the sandwiching portion sandwiching the flat plate portion having the through hole or the cutaway portion of the shaft member between the bottom wall and the sandwiching portion when the sending-out member is moved in the axial direction while the sandwiching portion is inserted in the through hole or the cutaway portion.

BRIEF DESCRIPTION OF THE DRAWINGS

Exemplary embodiments of the present invention will be described in detail based on the following figures, wherein.

DETAILED DESCRIPTION

An exemplary transporting device and an exemplary image forming apparatus according to a first exemplary embodiment of the present invention will be described with reference to FIGS. 1 to 12.

Overall Structure

Figure 12:
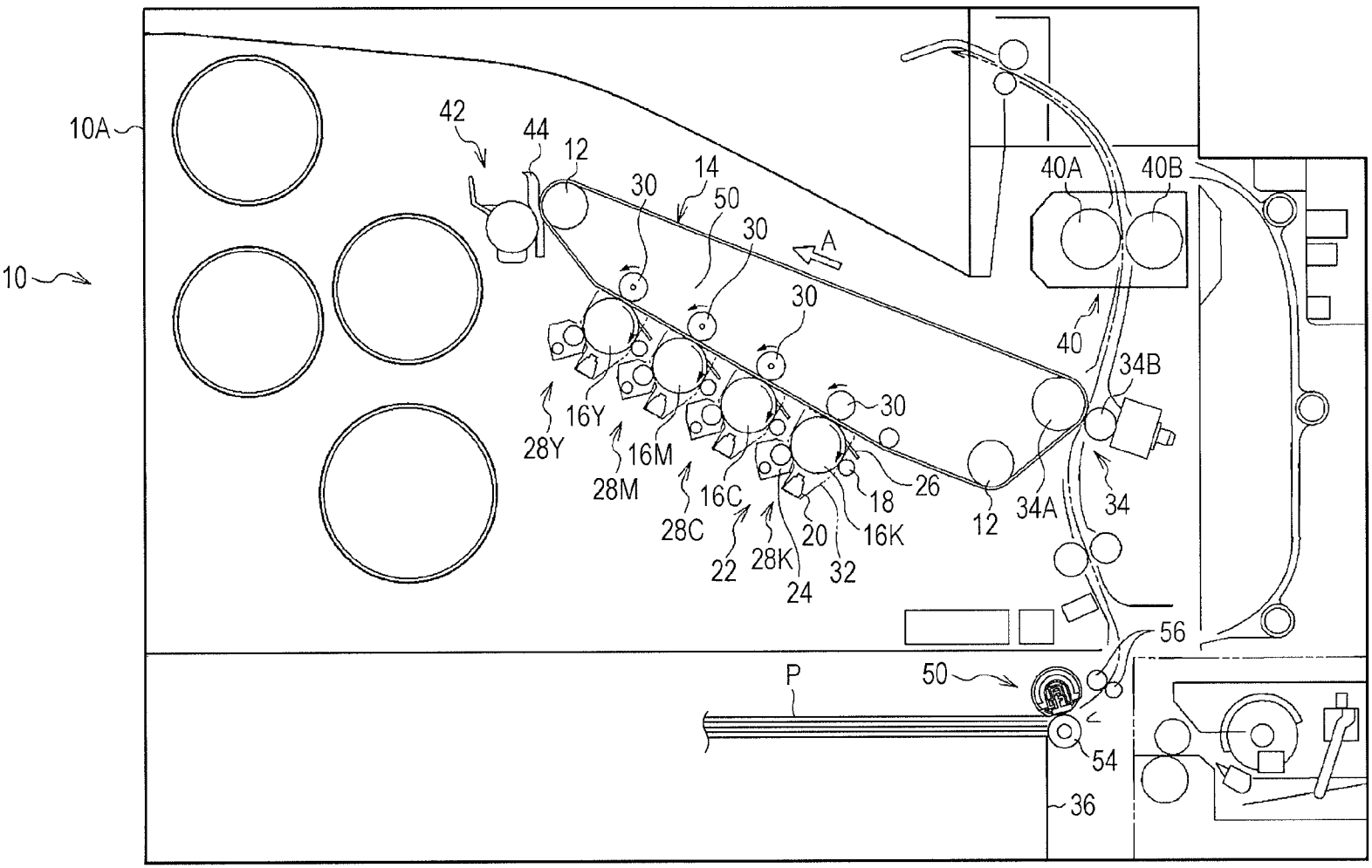
FIG. 12 is a schematic structural view of an image forming apparatus using the transporting device according to the exemplary embodiment of the present invention.

As shown in FIG. 12, an apparatus body 10A of an image forming apparatus 10 is provided with an endless intermediate transfer belt 14 serving as an intermediate transfer body that is placed upon rollers 12 in a stretched manner and that is moved in the direction of arrow A by driving of a motor (not shown).

In the image forming apparatus 10, image generating sections 28Y, 28M, 28C, and 28K that allow color images to be formed and that generate toner images for respective colors, yellow (Y), magenta (M), cyan (C), and black (K) are provided along a longitudinal direction of the intermediate transfer belt 14.

Alphabets Y, M, C, and K that indicate the respective colors are added after the reference numerals of the members provided for the respective colors. When the members is capable of being described without indicating the colors, they will be described without adding the alphabets after the reference numerals.

Each of the image generating sections 28 includes a photoconductor drum 16 serving as an exemplary image bearing member that is rotated clockwise by a driving unit including a motor and a gear (not shown).

Charging rollers 18 for uniformly charging the surfaces of the photoconductor drums 16 to a determined potential are disposed at peripheral surfaces of the photoconductor drums 16 for the respective colors. The charging rollers 18 are conductive rollers, and are disposed so that their peripheral surfaces contact the peripheral surfaces of the respective photoconductor drums 16 and so that an axial direction of the charging rollers 18 and an axial direction of the photoconductor drums 16 are parallel to each other.

Light emitting diode (LED) print heads 20 that form latent images on the respective photoconductor drums 16 by irradiating the photoconductor drums 16 with light beams are provided at the peripheral surfaces of the photoconductor drums 16 situated downstream from the respective charging rollers 18 in a direction of rotation of the respective photoconductor drums 16 (hereunder simply referred to as the "downstream side"). The LED print heads 20 will hereunder be referred to as "LPHs 20".

Developing units 22 that form toner images by developing the latent images on the photoconductor drums 16 using toners of determined colors (yellow/magenta/cyan/black) are disposed downstream from the LPHs 20 at the peripheral surfaces of the photoconductor drums 16 for the respective colors.

The developing units 22 include respective cylindrical developing rollers 24 that are disposed near the photoconductor drums 16 and that are rotatably provided. Development bias is applied to the developing rollers 24 so that the toners in the developing units 22 are adhered to peripheral surfaces of the respective developing rollers 24. Then, by the rotations of the developing rollers 24, the toners adhered to the developing rollers 24 are transported to the peripheral surfaces of the photoconductor drums 16 and transferred to the photoconductor drums 16, so that the latent images on the photoconductor drums 16 are developed as the toner images.

Transfer rollers 30 serving as transfer members that transfer the toner images on the photoconductor drums 16 for the respective colors to the intermediate transfer belt 14 are provided downstream from the developing units 22 at the peripheral surfaces of the photoconductor drums 16 for the respective colors so as to be situated opposite to the photoconductor drums 16 with the intermediate transfer belt 14 being disposed therebetween. The transfer rollers 30 are charged to a determined potential, rotate counterclockwise, move the intermediate transfer belt at a determined speed, and push the intermediate transfer belt 14 against the photoconductor drums 16. This causes the transfer rollers 30 to transfer the toner images on the photoconductor drums 16 to the intermediate transfer belt 14.

Cleaning blades 26 that collect residual toner, such as transfer toner or toner remaining on the photoconductor drums 16 after the transfer are disposed downstream from the transfer rollers 30 at the peripheral surfaces of the photoconductor drums 16 for the respective colors. The cleaning blades 26 are disposed so that their angular portions contact the peripheral surfaces of the respective photoconductor drums 16. The cleaning blades 26 scrape off for collection, for example, any toner remaining on the photoconductor drums 16 that is not transferred to the intermediate transfer belt 14 and toner of other colors adhered to the photoconductor drums 16 during the transfer.

Here, the toner images of the respective colors formed by the image generating sections 28 for the respective colors are transferred to the intermediate transfer belt 14 so as to be superimposed upon each other. This causes a color toner image to be formed on the intermediate transfer belt 14. In the exemplary embodiment, the toner image transferred to the intermediate transfer belt 14 by superimposing the toner images of the four colors upon each other in this way is called a "final toner image."

A transfer device 34 serving as an exemplary image forming section including two opposing rollers 34A and 34B is disposed downstream from the four photoconductor drums 16 in a direction of movement of the intermediate transfer belt at a peripheral surface of the intermediate transfer belt 14. The final toner image on the intermediate transfer belt 14 is transferred to a sheet material P serving as an exemplary recording medium that is sent out by, for example, a transporting device 50 from a sheet holding section 36 provided at the bottom of the image forming apparatus 10, and that is transported to a location between the rollers 34A and 34B. The transporting device 50, etc., will be described below.

A fixing device 40 including a heating roller 40A and a pressure roller 40B is disposed in a transportation path of the sheet material P to which the final toner image is transferred. The sheet material P transported to the fixing device 40 is transported by being nipped between the heating roller 40A and the pressure roller 40B, so that, the toner on the sheet material P is melted, and is pressure-bonded and fixed to the sheet material P.

A cleaner 42 that collects any toner remaining on the intermediate transfer belt 14 that is not transferred to the sheet material P by the transfer device 34 is disposed downstream from the transfer device 34 in the direction of movement of the intermediate transfer belt 14 at an outer peripheral surface of the intermediate transfer belt 14. A blade 44 provided so as to contact the intermediate transfer belt 14 is provided at the cleaner 42. The blade 44 rubs off any residual toner, to collect the residual toner.

In the image forming apparatus 10 having the above-described structure, an image is formed as follows.

First, the charging rollers 18 uniformly negatively charge the surfaces of the respective photoconductor drums 16 at a predetermined charging portion potential. In addition, latent images are formed on portions of the photoconductor drums 16 by performing exposure by the LHPs 20 so that images on the charged photoconductor drums 16 become a predetermined exposure portion potential.

Further, when the latent images on the rotating photoconductor drums 16 pass the developing rollers 24 of the developing units 22, toner of a developer G adheres to the latent images by electrostatic force, so that the latent images are made visible as toner images.

The toner images for the respective colors that have been made visible are successively transferred to the intermediate transfer belt 14 by electrostatic force of the transfer rollers 30, so that a final color toner image is formed on the intermediate transfer belt 14.

Further, the final toner image is transferred to a sheet material P taken out from the sheet holding section 36 and transported to a location between the rollers 34A and 34B of the transfer device 34.

The toner image transferred to the sheet material P is fixed to the sheet material P by the fixing device 40, and the sheet material P is discharged out of the image forming apparatus 10.

Structure of Principle Portion

Next, the transporting device 50, etc. will be described.

Figure 1:
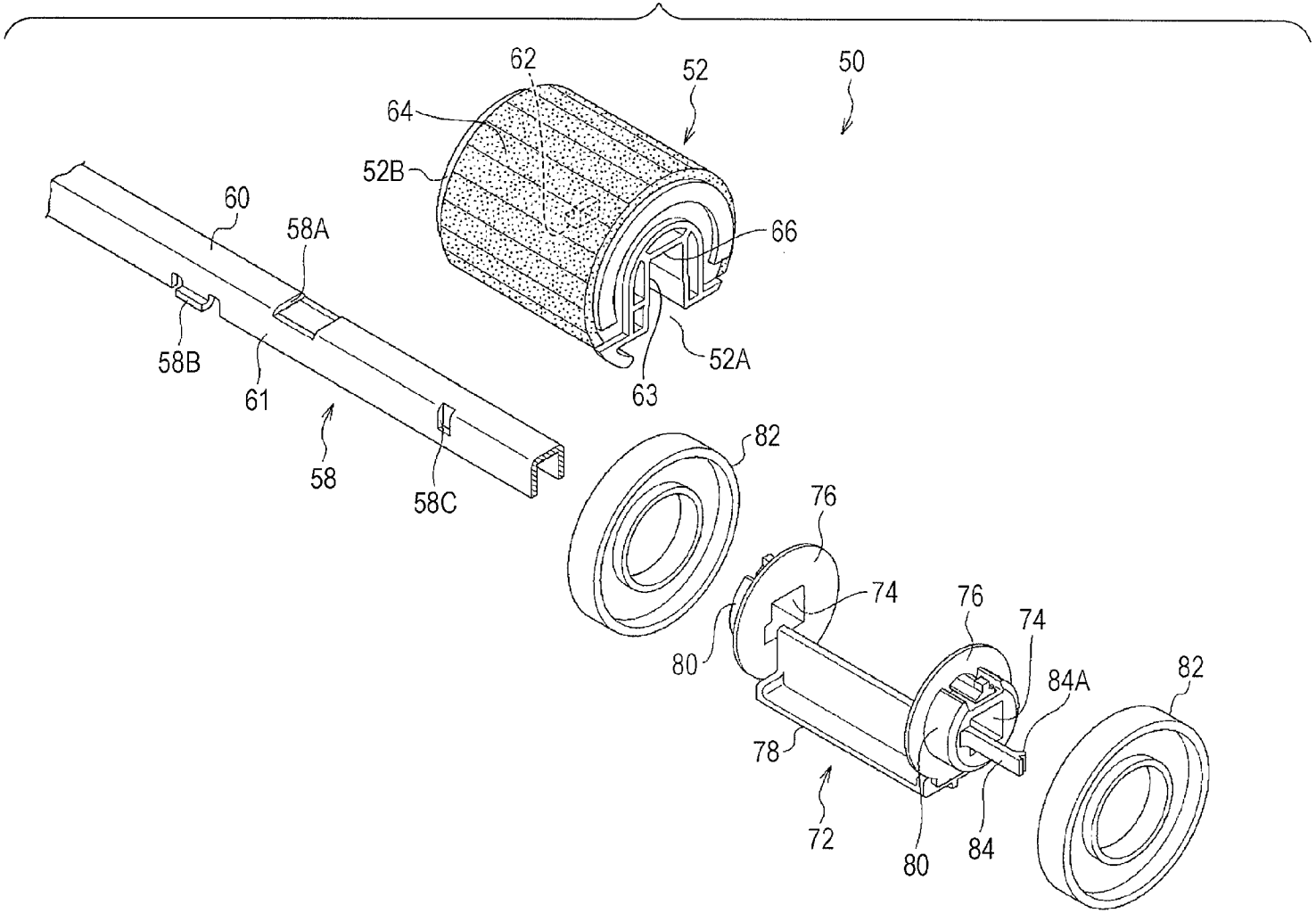
FIG. 1 is an exploded perspective view of a transporting device according to an exemplary embodiment of the present invention.
Figure 8:
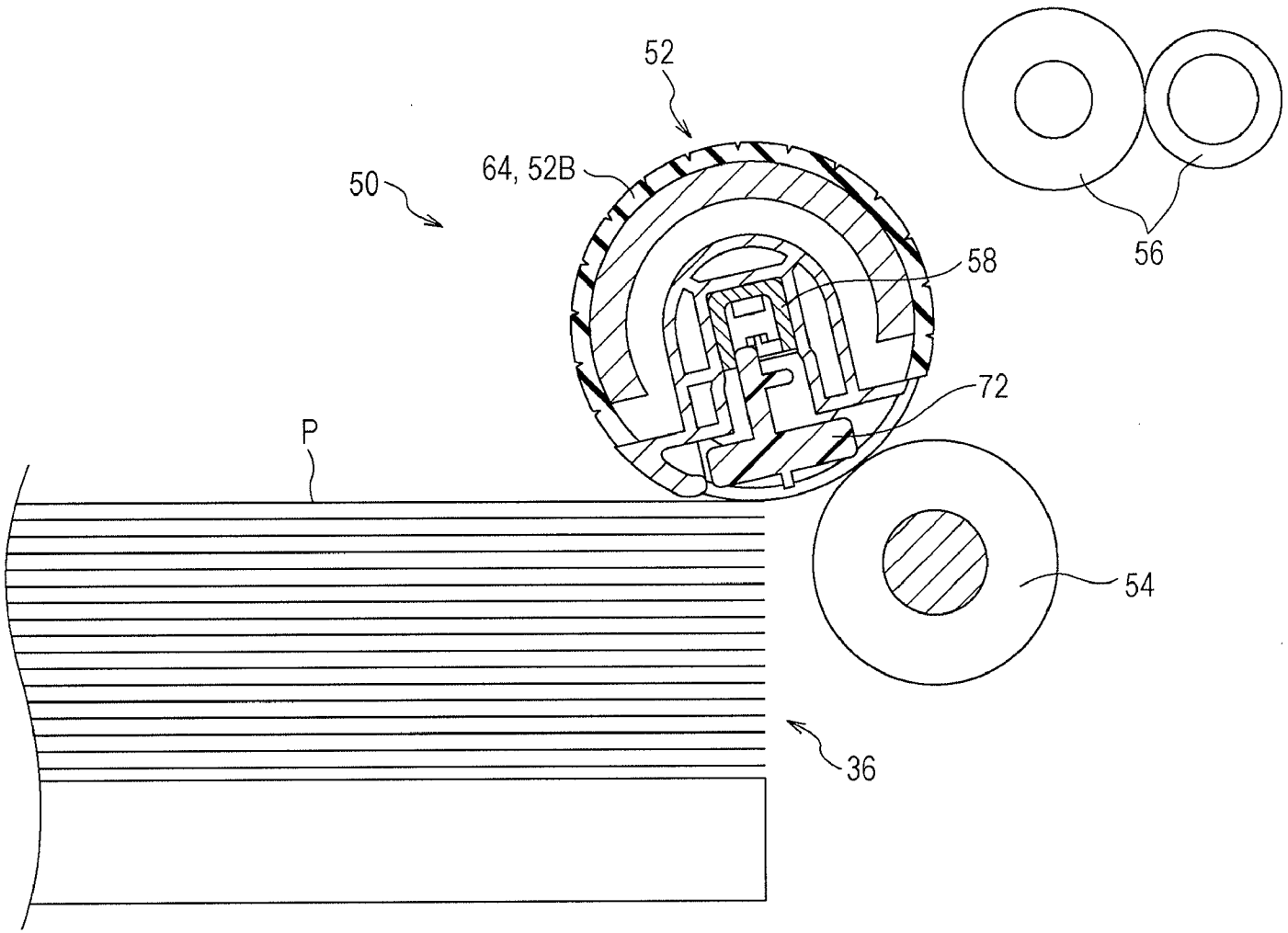
FIG. 8 is a side view of the transporting device, the double-feeding prevention roller, and the receiving rollers according to the exemplary embodiment of the present invention.

As shown in FIGS. 1 and 8, the transporting device 50 includes a long shaft member 58 and a sending-out roller 52. The shaft member 58 rotates when driving force is transmitted thereto. The sending-out roller 52 is an exemplary sending-out member that is mounted to the shaft member 58 and that contacts the topmost sheet material P loaded at the sheet holding section 36.

A double-feeding prevention roller 54 that is driven and rotated when the sending-out roller 52 rotates is provided at a position opposing the sending-out roller 52 of the transporting device 50. Receiving rollers 56 that receive the sheet material P sent out by the sending-out roller 52 and the double-feeding prevention roller 54 are provided.

A load is applied to the double-feeding prevention roller 54. When one sheet material P is transported to a location between the double-feeding prevention roller 54 and the sending-out roller 52, the double-feeding prevention roller 54 rotates. In contrast, when an attempt is made to transport two or more sheet materials P, the double-feeding prevention roller 54 does not rotate so as to allow sliding between the sheet materials. This prevents double feeding as a result of only the sheet material P that contacts the sending-out roller 52 being sent out.

As shown in FIG. 1, that shaft member 58 that is rotated when rotational force is transmitted thereto by a motor (not shown) is C-shaped in cross section that crosses a longitudinal direction. That is, the shaft member 58 has side plate portions 61 serving as a pair of exemplary opposing first flat plate portions, and a top plate portion 60 serving as an exemplary second flat plate portion that connects one widthwise-direction end of each side plate portion 61 to each other. The shaft member 58 is formed by bending a flat plate. In addition, a rectangular through hole 58A in which a sandwiching portion 62 (described later) is inserted is formed in the top plate portion 60 of the shaft member 58 so as to extend through the front and back of the top plate portion 60.

The sending-out roller 52 mounted to the shaft member 58 so as to surround the shaft member 58 has a form in which a portion of a columnar shape is cut away. A recessed open portion 52A is provided in the cutaway portion of the columnar shape of the sending-out roller 52 so as to be mounted to the shaft member 58 from a direction crossing an axial direction of the shaft member 58 (hereunder simply referred to as the "axial direction"). The position of the open portion 52A is determined so that the shaft member 58 is disposed at a rotational center of the sending-out roller 52 while the shaft member 58 is mounted to the open portion 52A.

A transporting portion 64 that is molded from a rubber material and that contacts and sends out a sheet material P is provided at an outer peripheral surface 52B of the sending-out roller 52. The sandwiching portion 62 is provided at a bottom wall 66 of the open portion 52A of the sending-out roller 52. The sandwiching portion 62 is inserted into the through hole 58A formed in the shaft member 58. When the sending-out roller 52 is moved in the axial direction while the sandwiching portion 62 is inserted in the through hole 58A, the top plate portion 60 of the shaft member 58 is sandwiched between the sandwiching portion 62 and the bottom wall 66. That is, the sandwiching portion 62 is disposed so as to be surrounded by the outer peripheral surface 52B of the sending-out roller 52.

Figure 4A:
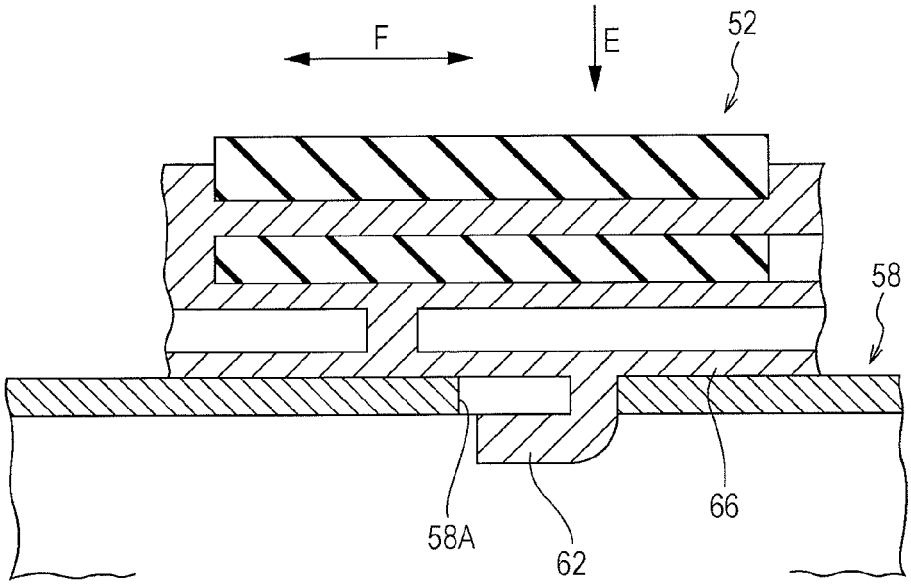
FIGS. 4A and 4B are sectional views of the transporting device according to the exemplary embodiment of the present invention.
Figure 4B:
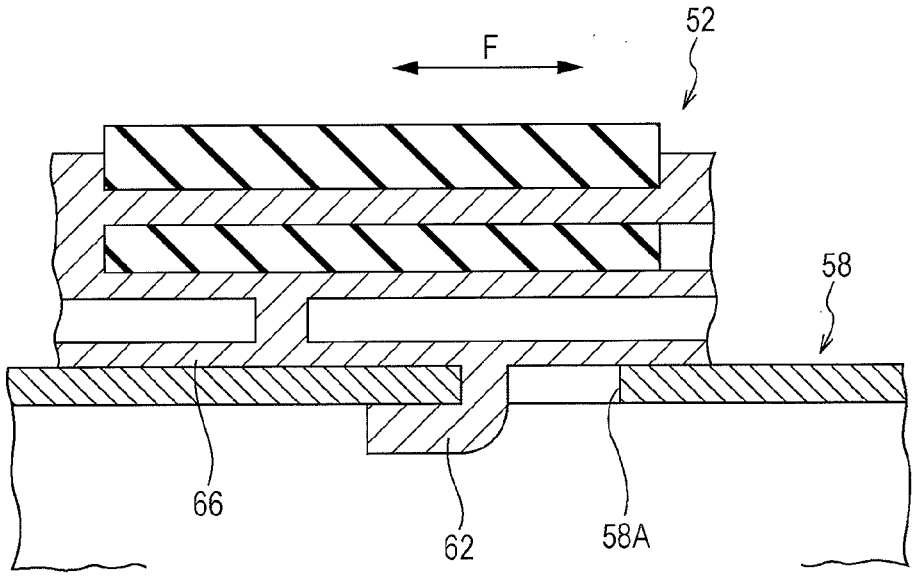

More specifically, as shown in FIGS. 4A and 4B, as viewed from a direction crossing the axial direction, the sandwiching portion 62 has an L shape. From a direction (that is, the direction of arrow E) crossing the axial direction, the sandwiching portion 62 is inserted into the through hole 58A (see FIG. 4A). When the sandwiching portion 62 is moved in the axial direction (that is, the direction of arrow F), the sandwiching portion 62 and the bottom wall 66 sandwich the top plate portion 60 (see FIG. 4B).

Figure 9:
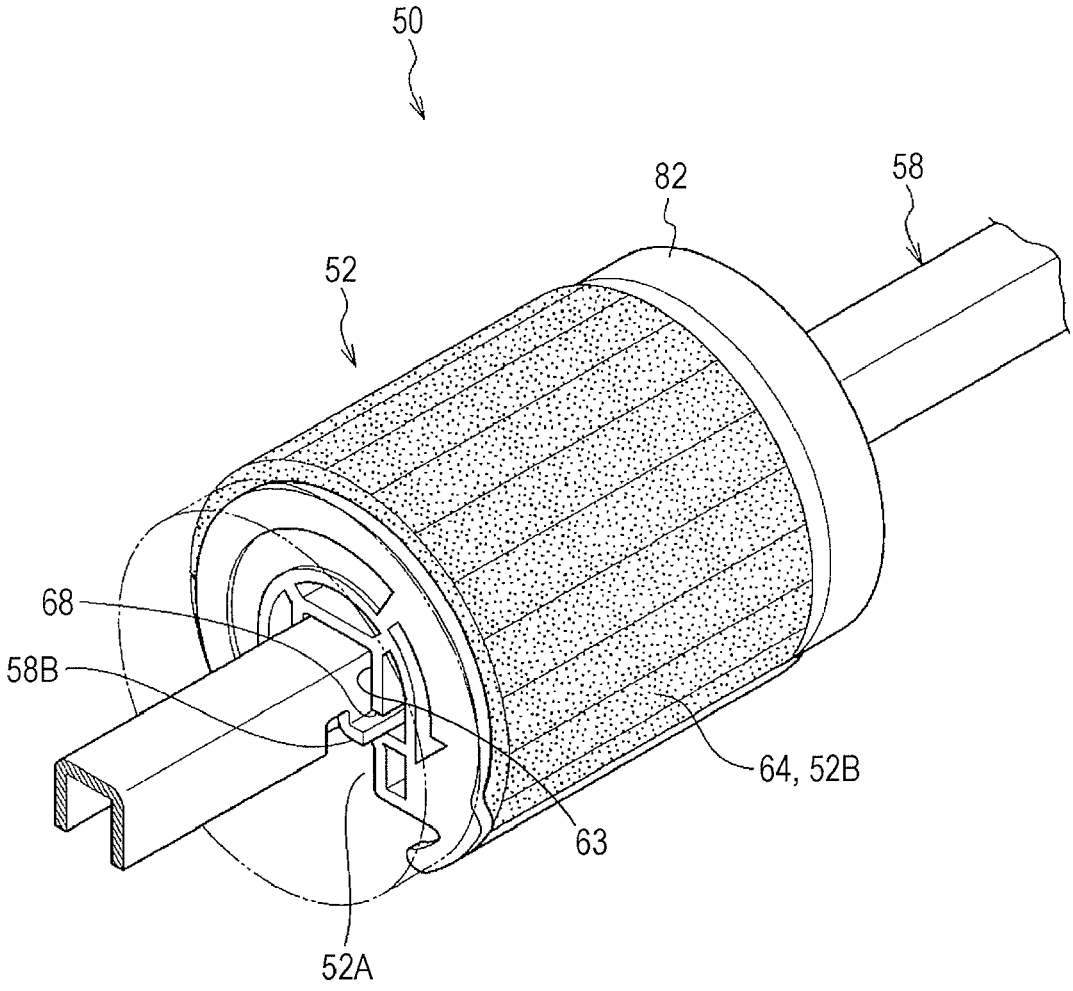
FIG. 9 is a perspective view of the transporting device according to the exemplary embodiment of the present invention.

As shown in FIG. 1, the shaft member 58 has a projection 58B that is formed by cutting and raising an edge of the shaft member 58 so as to protrude outward from the side plate portion 61 of the shaft member 58. As shown in FIG. 9, an engaging portion 68 is formed at a side wall 63 of the open portion 52A of the sending-out roller 52. The engaging portion 68 restricts the rotation of the sending-out roller 52 with respect to the shaft member 58 by engaging the projection 58B while the sending-out roller 52 is mounted to the shaft member 58. The projection 58B and the engaging portion 68 are disposed so as to be separated from the sandwiching portion 62 in the axial direction (see FIGS. 4A and 4B).

Figure 6:
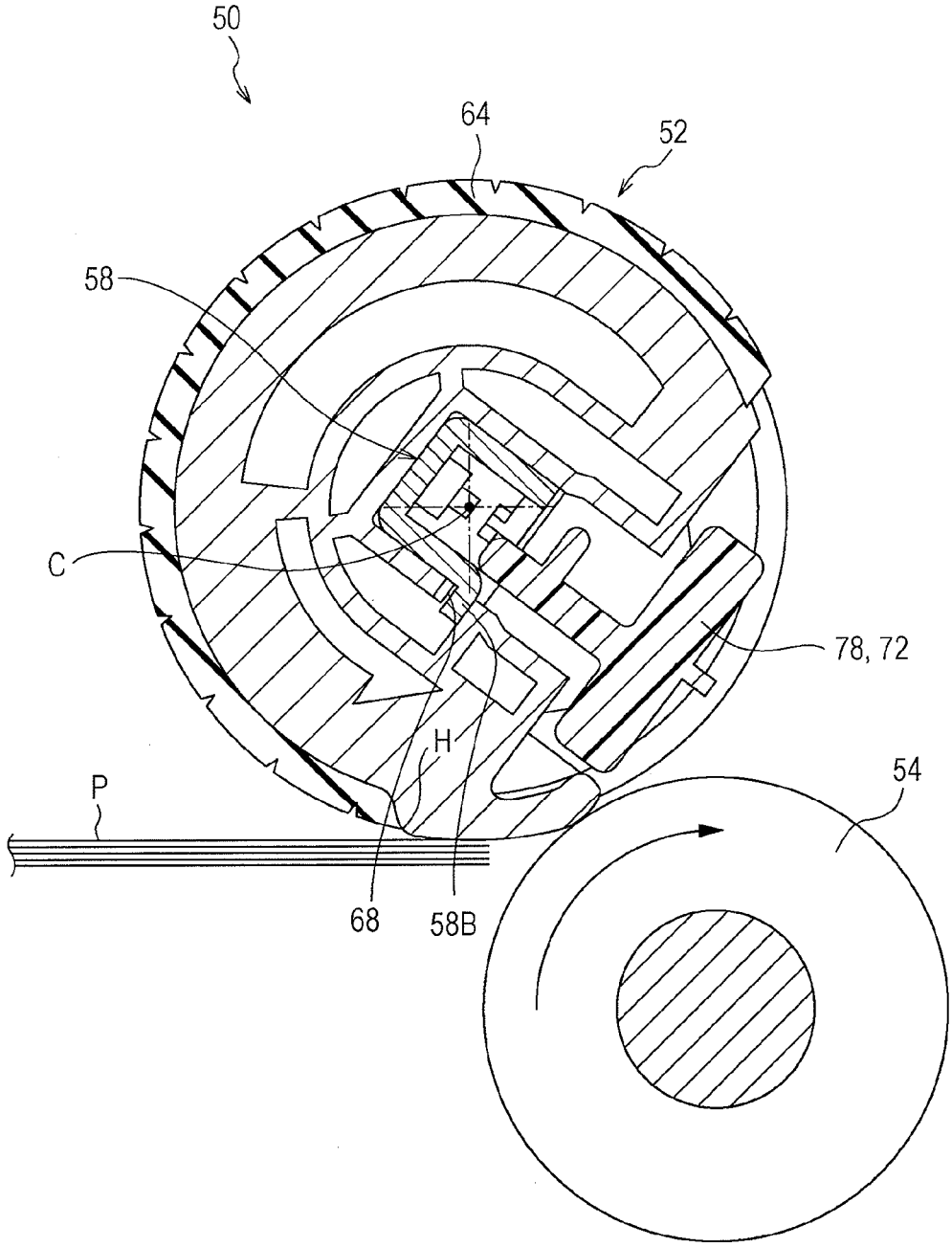
FIG. 6 is a sectional view of the transporting device and a double-feeding prevention roller according to the exemplary embodiment of the present invention.

As shown in FIG. 6, when the sending-out roller 52 starts sending out a sheet material P, as seen from the axial direction, the projection 58B and the engaging portion 68 are disposed at a contact H side, where the sending-out roller 52 contacts the sheet material P, with respect to a rotational axis C of the shaft member 58.

As shown in FIG. 1, a rectangular through hole 58C is formed in the side plate portion 61 of the shaft member 58. A holder member 72 serving as an exemplary restricting member provided with a pawl 84A that is fitted to the through hole 58C is provided.

More specifically, a pair of discs 76 having insertion holes 74 in which the shaft member 58 is inserted are formed at the holder member 72 so as to be separated by a certain distance from each other. The sending-out roller 52 is capable of entering a space formed between the pair of discs 76. In addition, a covering portion 78 that covers the open portion 52A of the sending-out roller 52 fitted between the pair of discs 76 is provided between the pair of discs 76. The pair of discs 76 are connected to each other by the covering portion 78.

Columnar portions 80 extending in the axial direction and having the aforementioned insertion holes 74 formed thereat are provided at the outer sides of the discs 76 (that is, at opposite sides of the covering portion 78). Disc-shaped rotating members 82 are rotatably mounted to the respective columnar portions 80. The rotating members 82 contact a sheet material P that is being transported and rotate when the outer peripheral surface 52B of the sending-out roller 52 separates from the sheet material P. That is, as viewed from the axial direction, the rotating members 82 are one size smaller than the sending-out roller 52, and are larger than the covering portion 78. With the outer peripheral surface 52B of the sending-out roller 52 being separated from the sheet material P (see FIG. 7C), the rotating members 82 contact the sheet material P that is being transported, and rotate, so that a transportation orientation of the sheet material P that is being transported is stabilized.

Figure 5A:
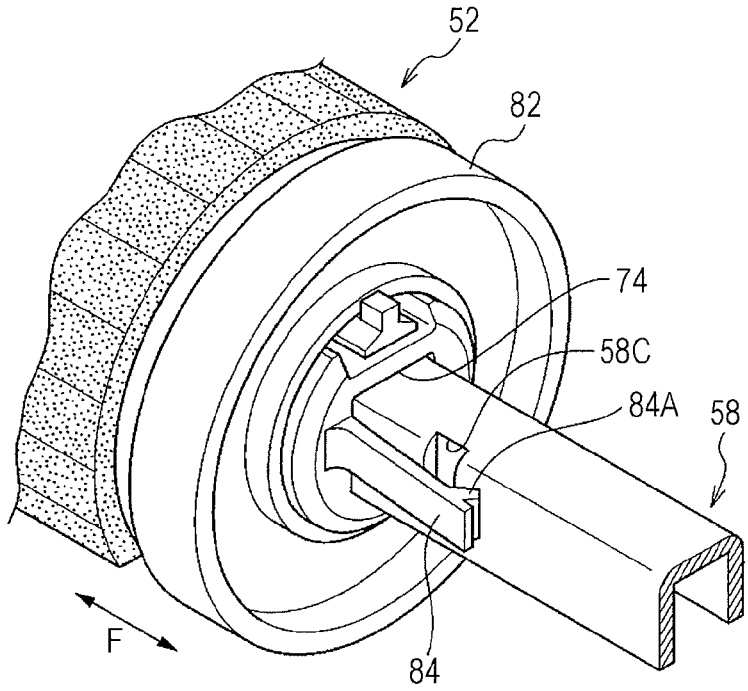
FIGS. 5A and 5B are perspective views of the transporting device according to the exemplary embodiment of the present invention.
Figure 5B:
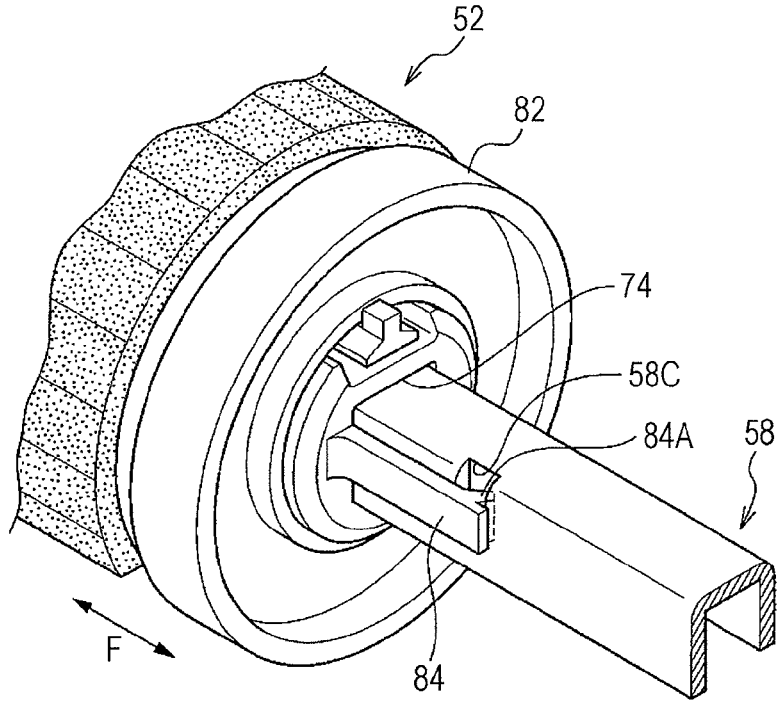

A holding portion 84 having the aforementioned pawl 84A is provided at one of the columnar portions 80 so as to protrude in the axial direction. The pawl 84A is provided at an end of the holding portion 84 so as to protrude towards the shaft member 58. As shown in FIGS. 5A and 5B, when the pawl 84A reaches the through hole 58C, the holding portion 84 that is pushed and resiliently deformed by the side plate portion 61 of the shaft member 58 as a result of inserting the shaft member 58 into the insertion holes 74 and moving the holder member 72 in the axial direction (that is, the direction of arrow F) is resiliently restored, so that the pawl 84A is fitted to the through hole 58C.

Accordingly, by fitting the pawl 84A to the through hole 58C, the movement of the holder member 72 is restricted in the axial direction with respect to the shaft member 58.

Next, a method of mounting the holder member 72, the sending-out roller 52, etc. to the shaft member 58 will be described.

Figure 2:
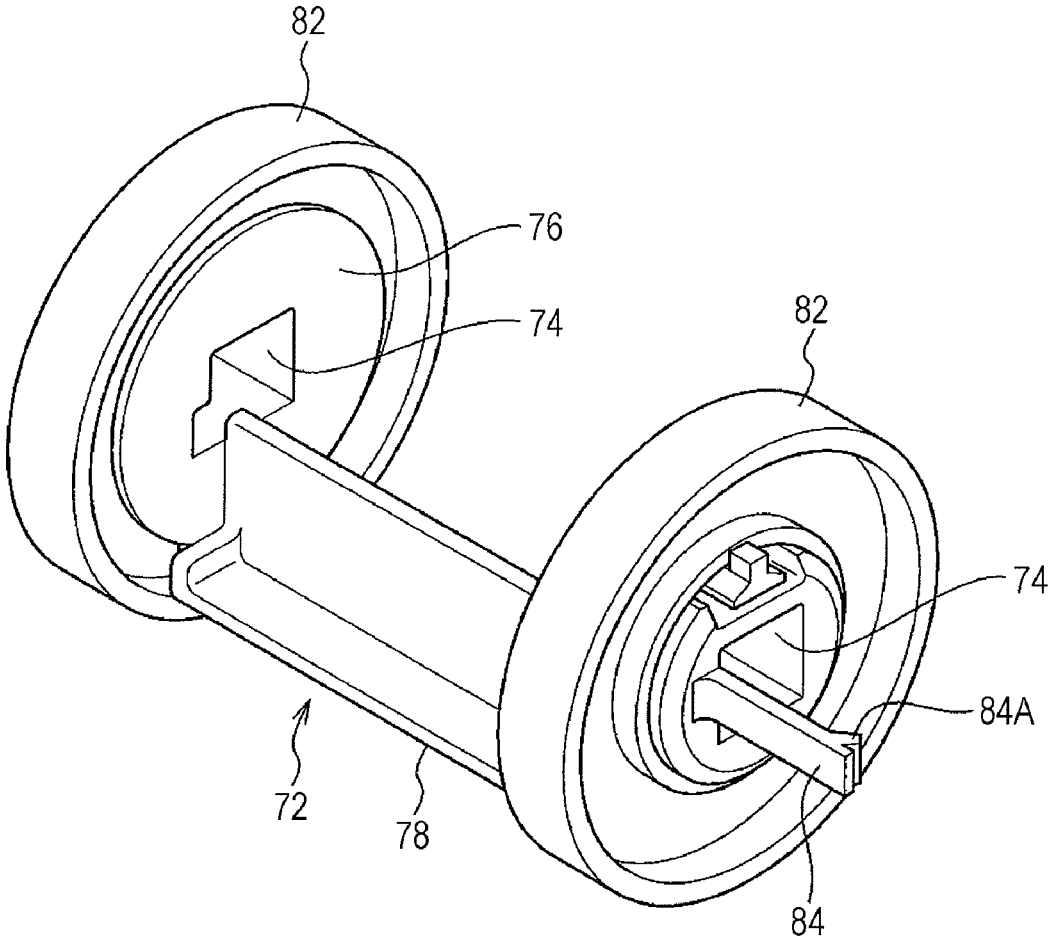
FIG. 2 is a perspective view of a holder member and rotating members used in the transporting device according to the exemplary embodiment of the present invention.

As shown in FIGS. 1 and 2, first, the rotating members 82 are rotatably mounted to the columnar portions 80 of the holder member 72. In this state, the shaft member 58 is inserted into the insertion holes 74 of the holder member 72 so that the covering portion 78 of the holder member 72 covers an open portion of the C-shaped shaft member 58.

Figure 3A:
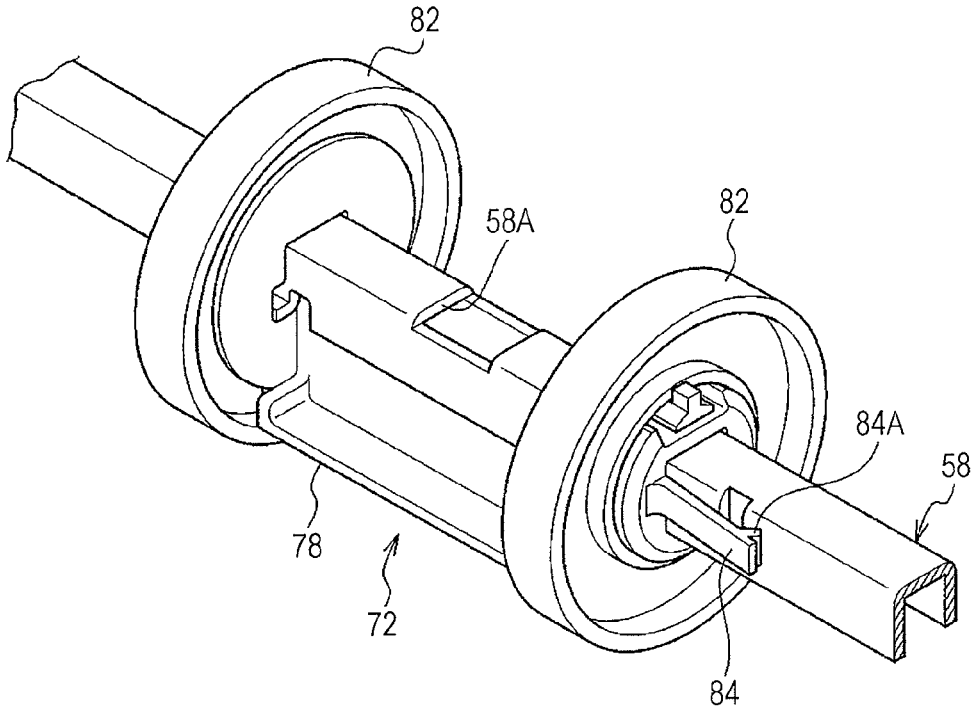
FIGS. 3A and 3B are perspective views of the transporting device according to the exemplary embodiment of the present invention.

As shown in FIGS. 3A and 4A, the movement of the holder member 72 in the axial direction is stopped before the pawl 84A of the holding portion 84 of the holder member 72 is fitted to the through hole 58C of the shaft member 58.

Figure 3B:
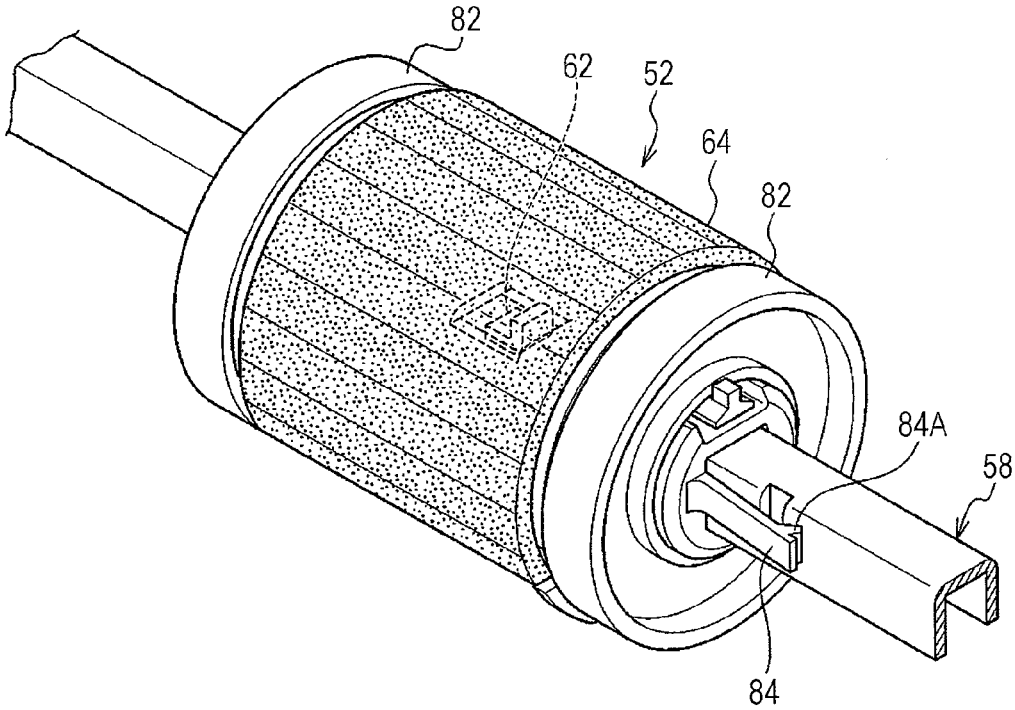

In this state, as shown in FIGS. 3B and 5A, the sending-out roller 52 is brought closer to the shaft member 58 from a direction crossing the axial direction. In order for the sending-out roller 52 to enter a location between the pair of discs 76, the bottom wall 66 of the open portion 52A of the sending-out roller 52 is made to contact the top plate portion 60 of the shaft member 58, and the sandwiching portion 62 is inserted into the through hole 58A.

Figure 10:
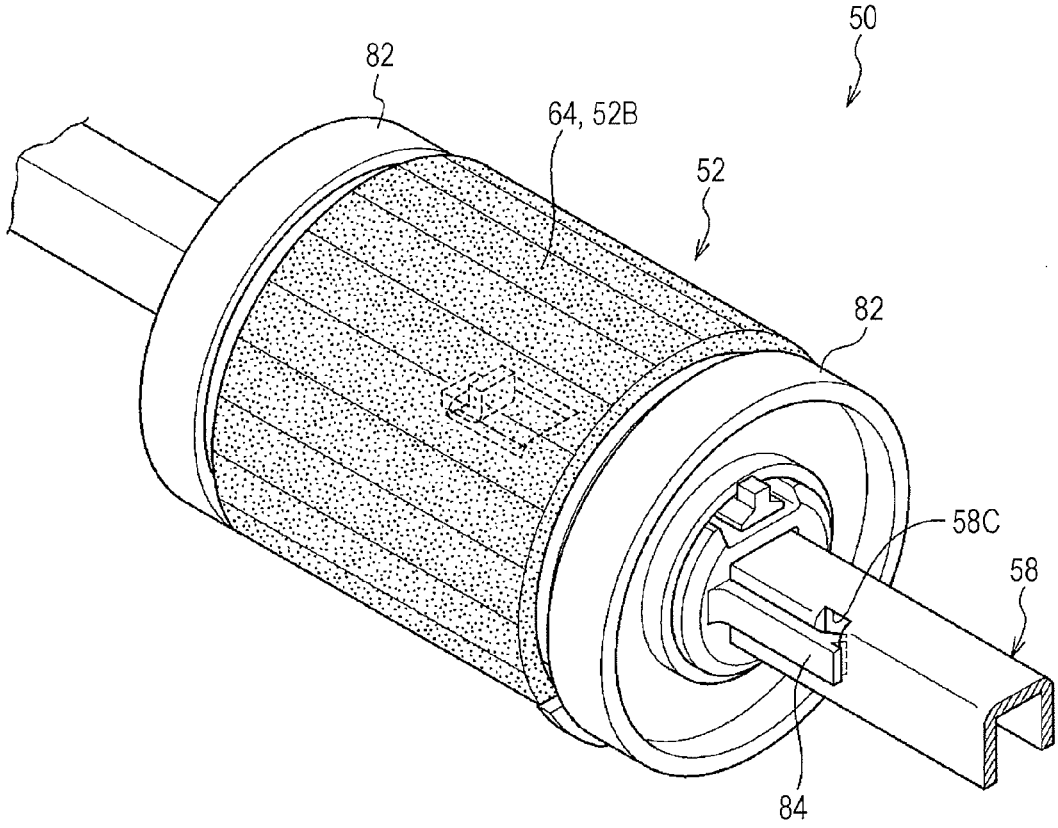
FIG. 10 is a perspective view of the transporting device according to the exemplary embodiment of the present invention.
Figure 11:
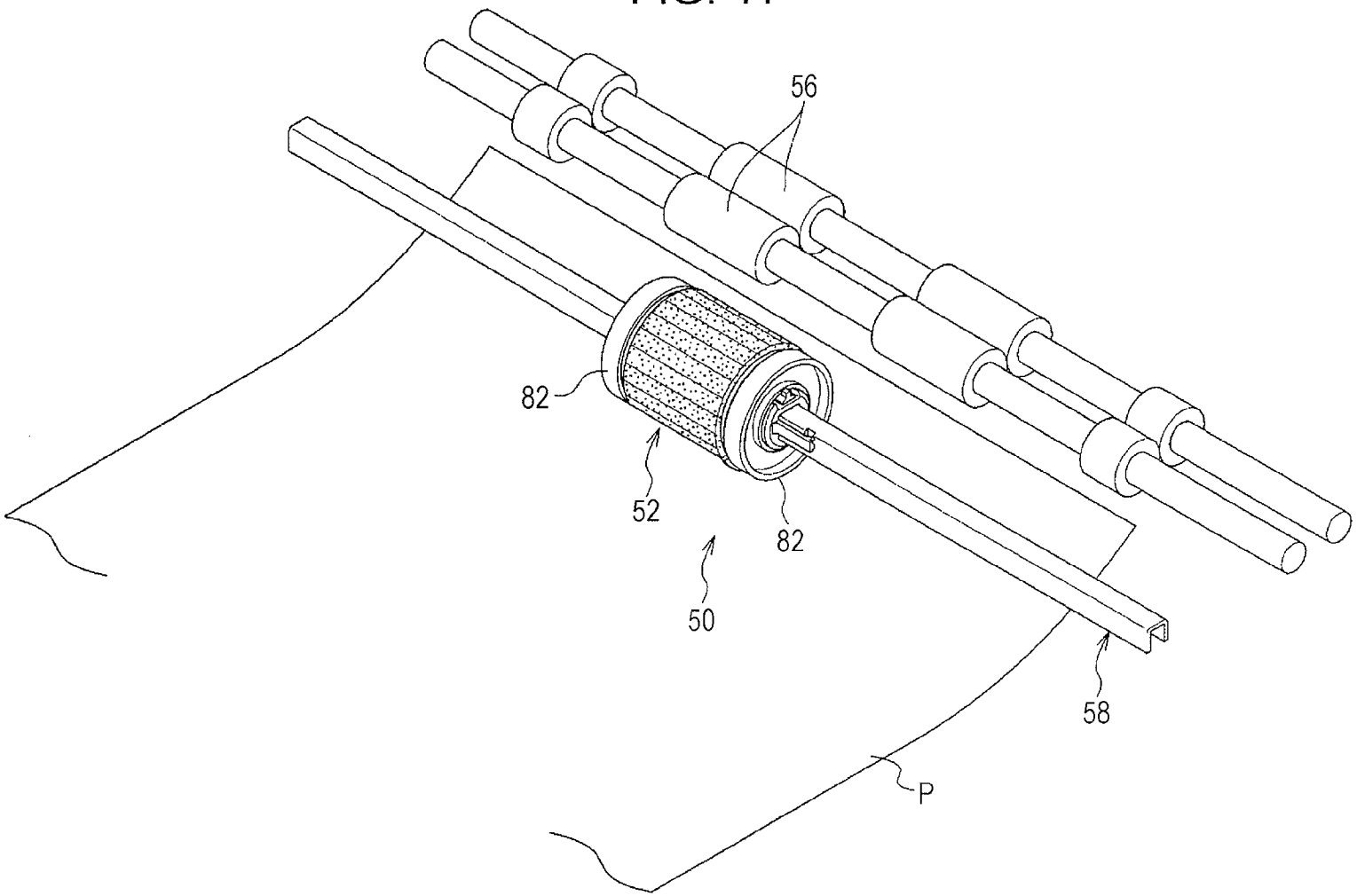
FIG. 11 is a perspective view of the transporting device, etc., according to the exemplary embodiment of the present invention.

In this state, as shown in FIGS. 4B, 5B, and 10, the sending-out roller 52 and the holder member 72 are moved in the axial direction, the pawl 84A of the holding portion 84 is fitted to the through hole 58C, and the top plate portion 60 of the shaft member 58 is sandwiched between the bottom wall 66 and the sandwiching portion 62. Accordingly, by sandwiching the top plate portion 60 between the bottom wall 66 and the sandwiching portion 62, movement of the sending-out roller 52 in a direction crossing the axial direction with respect to the shaft member 58 is restricted. In addition, fitting the pawl 84A to the through hole 58C causes the axial movement of the sending-out roller 52 interposed between the pair of discs 76 to be restricted.

The sending-out roller 52 and the holder member 72 are removed from the shaft member 58 by moving the pawl 84A out from the through hole 58*a*, and performing the above-described steps in the reverse order. That is, the sending-out roller 52 is replaced by performing the above-described steps.

Operation

Next, the operation performed when the transporting device 50 sends out a sheet material P, loaded at the sheet holding section 36, downstream in a direction of transport of the sheet material P will be described.

Figure 7A:
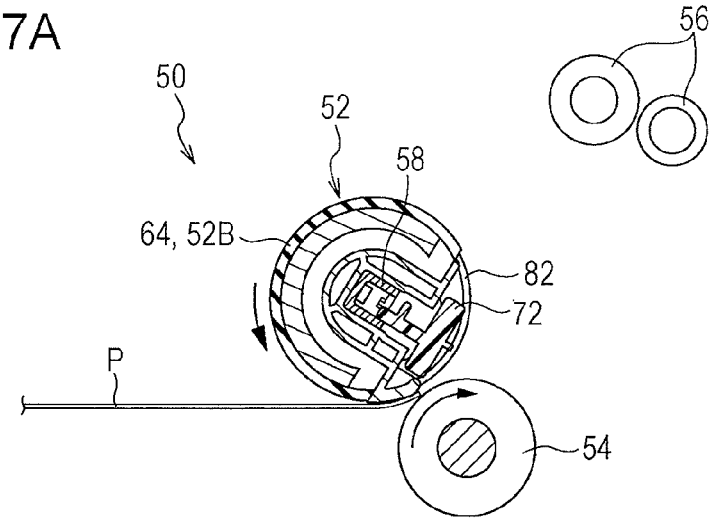
FIGS. 7A, 7B, and 7C are each a sectional view of the transporting device, the double-feeding prevention roller, and receiving rollers according to the exemplary embodiment of the present invention.

As shown in FIG. 7A, when a controller (not shown) gives an instruction to send out the sheet material P, loaded at the sheet holding section 36, downstream in the direction of transport of the sheet material P, the shaft member 58 rotates counterclockwise. By rotating the shaft member 58, the sending-out roller 52 that is disposed in an initial position of the sending-out roller 52 (see FIG. 8) also rotates counterclockwise.

By rotating the sending-out roller 52 counterclockwise, first, the outer peripheral surface 52B where the transporting portion 64 is not provided contacts the double-feeding prevention roller 54 to stabilize the rotation of the sending-out roller 52. Next, a topmost sheet material P that contacts the transporting portion 64, provided at the outer peripheral surface 52B of the sending-out roller 52, is sent out downstream in the direction of transport of the sheet material P by friction force, generated between the transporting portion 64 and the sheet material P, while the sheet member P is nipped between the sending-out roller 52 and the double-feeding prevention roller 54.

Figure 7B:
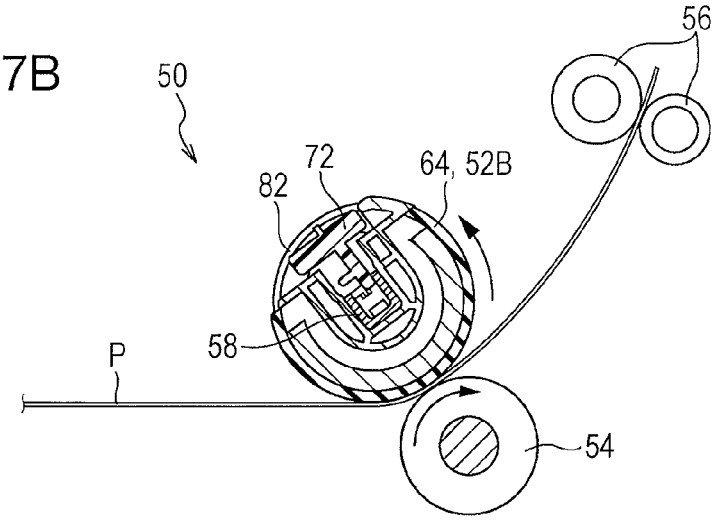

As shown in FIG. 7B, the sheet material P that is sent out from the sheet holding section 36 is received by the receiving rollers 56. The receiving rollers 56 are rotated and driven, so that the sheet material P is transported downstream in the direction of transport of the sheet material P.

Figure 7C:
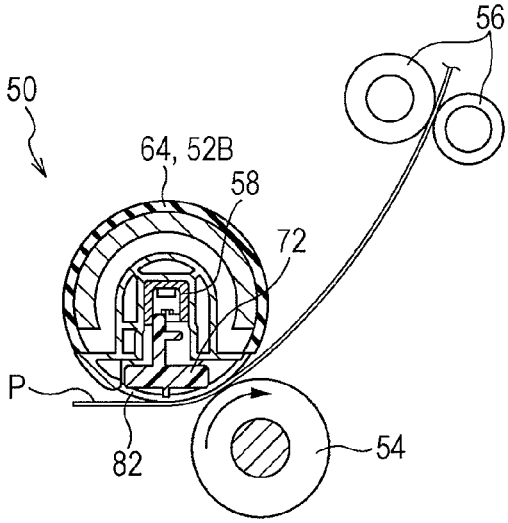

As shown in FIG. 7C, the sending-out roller 52 rotates once, returns to its initial position, and stops. At the initial position, the open portion 52A of the sending-out roller 52 and the double-feeding prevention roller 54 oppose each other, and the outer peripheral surface 52B of the sending-out roller 52 provided with the transporting portion 64 separates from the double-feeding prevention roller 54 and the sheet material P.

When the outer peripheral surface 52B of the sending-out roller 52 separates from the sheet material P, the rotating members 82, provided at the respective ends of the holder member 72, contact the sheet material P that is being transported, and rotate, so that the sheet material P is transported between the double-feeding prevention roller 54 and the rotating members 82 while the transportation orientation of the sheet material P is stabilized. That is, when the outer peripheral surface 52B of the sending-out roller 52 is separated from the sheet material P, rotational driving force of the receiving rollers 56 causes the sheet material P to be transported downstream, and the rotating members 82 are rotated by contacting the sheet material P that is moving. In this way, the sending-out roller 52 causes the sheet material P at the sheet holding section 36 to be sent out downstream in the direction of transport of the sheet material P.

As described above, when the sandwiching portion 62 that mounts the sending-out roller 52 to the shaft member 58 is provided so as be to surrounded by the outer peripheral surface 52B of the sending-out roller 52 instead of being provided at one end of the sending-out roller 52 in the axial direction, rattling occurring between the sending-out roller 52 and the shaft member 58 in a direction crossing the axial direction is suppressed.

Since a rotation suppressing member 70 and the sandwiching portion 62 are disposed so as to be displaced from each other in the axial direction, rattling occurring between the sending-out roller 52 and the shaft member 58 in a direction crossing the axial direction is further suppressed.

As viewed from the axial direction, with respect to the rotational axis of the shaft member 58, the projection 58B and the engaging portion 68 are disposed at a side where the sending-out roller 52 contacts the sheet material P when the sending out of the sheet material P is started. In the case where the projection 58B and the engaging portion 61 are not at the side where the sending-out roller 52 contacts the sheet material P, when the sending out of the sheet material P is started, the sending-out roller 52 moves in the direction in which it separates from the shaft member 58. However, since they are disposed at the side where the sending-out roller 52 contacts the sheet material P, the sending-out roller 52 contacts the shaft member 58, so that rattling occurring between the sending-out roller 52 and the shaft member 58 around the axial direction when the sheet material P is sent out is suppressed.

The covering portion 78, provided at the holder member 72, covers the open portion 52A of the sending-out roller 52 mounted to the shaft member 58. Therefore, accidental entry of foreign matter into the open portion 52A is suppressed.

By suppressing rattling of the sending-out roller 52 with respect to the shaft member 58, the sheet material P is transported stably.

Since the shaft member 58 is molded by bending a flat plate, the shaft member 58 has a low-cost structure.

Although the present invention is described in detail with reference to a specific exemplary embodiment, the present invention is not limited to such an exemplary embodiment. It is obvious to those skilled in the art that various other embodiments are possible within the scope of the present invention. For example, although, in the above-described embodiment, the shaft member 58 is C-shaped in cross section, the shaft member 58 may also be square-shaped, etc.

In addition, although, in the above-described embodiment, the sandwiching portion 62 is inserted in the through hole 58A, it is possible to insert an insertion portion into a cutaway portion at an end portion of the shaft member and mount the sending-out roller.

What is claimed is:

1. A recording medium transporting device comprising:

a long shaft member that rotates when driving force is transmitted thereto, the shaft member including a pair of first flat plate portions, a second flat plate portion, and a through hole or a cutaway portion, the pair of first flat plate portions opposing each other in cross section that crosses a longitudinal direction, the second flat plate portion connecting a widthwise-direction end of each first flat plate portion to each other, the pair of first flat plate portions and the second flat plate portion forming a rectangular shape, the through hole or the cutaway portion being formed in one of the flat plate portions;

a sending-out member whose outer peripheral surface contacts a topmost recording medium that is loaded, the sending-out member having a recessed open portion provided in a portion of the outer peripheral surface, the shaft member being fitted to the open portion from a direction that crosses an axial direction of the shaft member, the sending-out member sending out the topmost recording medium that is loaded while the sending-out member rotates as a result of the rotation of the shaft member fitted to the open portion; and a sandwiching portion provided at a bottom wall of the open portion of the sending-out member, the sandwiching portion capable of being inserted into and removed from the through hole or the cutaway portion from the direction that crosses the axial direction of the shaft member, the sandwiching portion sandwiching the flat plate portion having the through hole or the cutaway portion of the shaft member between the bottom wall and the sandwiching portion when the sending-out member is moved in the axial direction while the sandwiching portion is inserted in the through hole or the cutaway portion; and a projection and an engaging portion, the projection projecting towards a side wall of the open portion in the sending-out member from the shaft member, the engaging portion being provided at the side wall at a location that is separated from the sandwiching portion, provided at the bottom wall of the open portion, in the axial direction, the engaging portion engaging the projection to restrict the rotation of the sending-out member with respect to the shaft member.

2. The recording medium transporting device according to claim 1, wherein, as seen from the axial direction, with respect to a rotational axis of the shaft member, the projection and the engaging portion are disposed at a side where the sending-out member contacts the recording medium, when the sending-out member starts sending out the recording medium.

3. The recording medium transporting device according to claim 1, further comprising a restricting member and a covering member, the restricting member being mounted in a state in which relative displacement thereof with respect to the shaft member in the axial direction is restricted, the restricting member restricting relative displacement of the sending-out member, mounted to the shaft member, in the axial direction with respect to the shaft member, the covering portion being provided at the restricting member and covering the open portion of the sending-out member.

4. The recording medium transporting device according to claim 3, wherein the restricting member has a rotating member rotatably mounted thereto, the rotating member coming into contact with the recording medium and rotating when the outer peripheral surface of the sending-out member separates from the recording medium.

5. An image forming apparatus comprising:

the recording medium transporting device according to claim 1; and an image forming section that forms an image on the recording medium that is transported by the recording medium transporting device.

* * * * *